US008168007B1

(12) United States Patent
Riha et al.

(10) Patent No.: US 8,168,007 B1
(45) Date of Patent: May 1, 2012

(54) MULTI-FUNCTION HOSE MAINTENANCE SYSTEM

(75) Inventors: Gary Riha, Green Bay, WI (US); Michael J. Hucovski, Hobart, WI (US)

(73) Assignee: Pump Systems, LLC, Dickinson, ND (US)

( * ) Notice: Subject to any disclaimer, the term of this patent is extended or adjusted under 35 U.S.C. 154(b) by 654 days.

(21) Appl. No.: 12/142,383

(22) Filed: Jun. 19, 2008

(51) Int. Cl.
*B08B 3/00* (2006.01)

(52) U.S. Cl. ..... 134/64 R

(58) Field of Classification Search ..... 134/64 R
See application file for complete search history.

(56) References Cited

U.S. PATENT DOCUMENTS

| | | | | | |
|---|---|---|---|---|---|
| 1,652,718 | A | * | 12/1927 | Huntington | 242/380 |
| 2,909,794 | A | * | 10/1959 | McGraw et al. | 15/40 |
| 3,057,497 | A | * | 10/1962 | Stadelman | 414/416.06 |
| 4,493,188 | A | * | 1/1985 | Marsh | 60/468 |
| 4,842,001 | A | * | 6/1989 | O'Leary | 134/112 |
| 5,040,259 | A | * | 8/1991 | Ishii et al. | 15/40 |
| 5,224,236 | A | * | 7/1993 | Sallquist | 15/321 |
| 5,322,571 | A | * | 6/1994 | Plummer et al. | 134/22.12 |
| 5,356,480 | A | * | 10/1994 | Melgeorge | 134/15 |
| 5,649,616 | A | * | 7/1997 | Stecklow | 198/496 |
| 5,678,599 | A | * | 10/1997 | Moss | 137/377 |
| 6,099,660 | A | * | 8/2000 | Davis et al. | 134/21 |
| 2006/0076835 | A1 | * | 4/2006 | Slocum | 307/29 |
| 2007/0114162 | A1 | * | 5/2007 | Stiles et al. | 210/137 |

FOREIGN PATENT DOCUMENTS

DE 4447168 * 7/1996

OTHER PUBLICATIONS

Machine translation of de4447168 (Jul. 1996).*
Pump Systems, Hose Station Multi-Function Decontamination Systems Owner's Manual, published in the US.

* cited by examiner

*Primary Examiner* — Michael Barr
*Assistant Examiner* — David Cormier
(74) *Attorney, Agent, or Firm* — Andrus, Sceales, Starke & Sawall, LLP

(57) ABSTRACT

A multi-function washing and decontamination system for a hose is provided. The multi-function system includes a wash unit, a submersion unit, a hose test unit and a control unit. The control unit controls a motor driven pump and a blower unit in one embodiment. In another embodiment, the multi-function system is portable and is mounted on a trailer having at least one wheel. The wash unit of the multi-function washing and decontamination system of the present application includes a plurality of adjustable rollers and a flexible track defining a hose path that includes at least one nozzle for washing the hose and at least one air knife for drying the hose. The multi-function washing and decontamination system also includes a submersion unit for pre-soaking a hose prior to entry of the wash unit in a solution that decontaminates the hose. The multi-function washing and decontamination system may also include a hose test unit for testing a hose after washing and decontamination.

28 Claims, 3 Drawing Sheets

MULTI-FUNCTION HOSE MAINTENANCE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON A COMPACT DISC

Not Applicable

BACKGROUND AND SUMMARY

The present application relates to hose maintenance and cleaning systems, particularly to hose maintenance and cleaning systems and units for washing and decontamination of hoses. The multi-function hose maintenance system of the present application may also provide a means for testing the hose after it is cleaned or decontaminated.

Multi-function washing and decontamination systems for hoses are known in the art. However, prior art systems lack the capacity to provide pre-soak features and drying of a hose after washing and decontamination. Lack of these features often creates a problem of mildew or other contaminant build-up and creates the necessity to run the hose through the system multiple times. The multi-function hose maintenance and testing system of the present application may be used on any type of a hose, including but not limited to, fire hoses, fuel hoses, chemical hoses, and any other hose that one would desire to have cleaned.

Accordingly, the present application provides for a portable, multi-function system for maintenance and testing of a hose. The portable multi-function system of the present application includes a multi-function unit that comprises a submersion unit, a washing unit, a control unit, a motor driven pump, a motor driven air compressor, and a hose test unit. The portable multi-function system for maintenance and testing of a hose may be arranged on a trailer for supporting the system and providing mobility. The trailer may include a trailer arm having a coupler for coupling the trailer to a vehicle, a platform for supporting the multi-function unit, at least one wheel, and at least one jack for supporting the trailer in a stationary position.

The submersion unit provides a submersion soak tank and a hose spool for supporting a hose to be washed or decontaminated. The hose spool has an arm and a pivot that allows a hose to be lowered into and raised out from the submersion soak tank when the hose is arranged on the spool. A heating unit having a heating element is provided to heat water or solution contained in the submersion soak tank.

After a hose is treated in the submersion unit, the hose is fed from the hose spool into the wash unit. The wash unit receives the hose from the submersion unit hose spool and comprises a plurality of adjustable roller units supporting a flexible track. At least one of the roller units is a power roller unit for generating a moving force for the flexible track. A plurality of roller spacers are provided for tensioning the flexible track along the plurality of rollers. Additionally, a plurality of nozzles are provided for supplying pressurized water or solution to the hose as it travels through the wash unit. At least one air knife is provided at the terminal end of the wash unit for drying the hose. A reservoir tank is located below the roller and flexible track for collecting used water or solution. The wash unit defines a hose path, wherein a portion of the flexible track is located above the hose, and a portion of the flexible track is located below the hose path such that the hose is fed from the hose spool and through the hose path. The series of rollers that support the flexible track are adjustable to accommodate the bulky nozzle of a hose as the hose nozzle passes along the hose path, and then adjusts to maintain frictional contact with the remainder of the hose as it travels along the hose path. In one embodiment, an air knife is supplied adjacent the upper track and another adjacent the lower track to dry both sides of the hose as it exits the hose path. The nozzles wash the hose as it travels along the hose path and the air knives dry the hose as it exits the hose path. In one embodiment, a reservoir tank is located below the hose path to collect waste water or waste solution.

The control unit of the multi-function hose maintenance and testing system includes an electrical box that houses a PLC controller. The electrical box also may house a wash controller, at least one motor starter, a fuse box, a ground fault and an optional PLC power converter for converting single phase power to three phase power. The at least one motor starter operates to start a motor that drives the aforementioned air compressor unit and/or the aforementioned motor driven pump. In one embodiment, a separate motor starter is provided for the pump and the air compressor motors. The contents of the electrical box are connected to a control panel. The control panel includes an operator accessible master on/off switch and operator accessible PLC interface. The control panel also may include a pressure washer control for operating an optional hand held pressure wash gun. The air compressor unit comprises a motor, an air intake, an air filter and an air outlet. The motor driven pump includes a motor, a pump for pumping fluid and an optional fluid heater. The motor driven pump and the air compressor unit supply pressurized fluid to a manifold of a hose test unit, and may also support operation of the wash nozzles, air knives and hand held pressure wash gun.

The hose test unit includes a manifold and a plurality of hose fittings. An operator may attach a hose to be tested to one of the hose fittings and pressurized water may be pumped to the hose to test the hose for leaks and/or any other maintenance that may be required.

As mentioned, the multi-function hose maintenance and testing system may be mobile on a trailer such that an operator may move the multi-function system to a preferred location. To that end, the reservoir tank of the wash unit includes a drain that may be opened or closed by an operator. Accordingly, an operator may use the system in one location, collect waste water or solution from the wash unit in the reservoir tank, and subsequently locate the unit to another location where the waste water or solution may be disposed of in an environmentally sound manner.

DETAILED DESCRIPTION OF THE INVENTION

Figure 1:
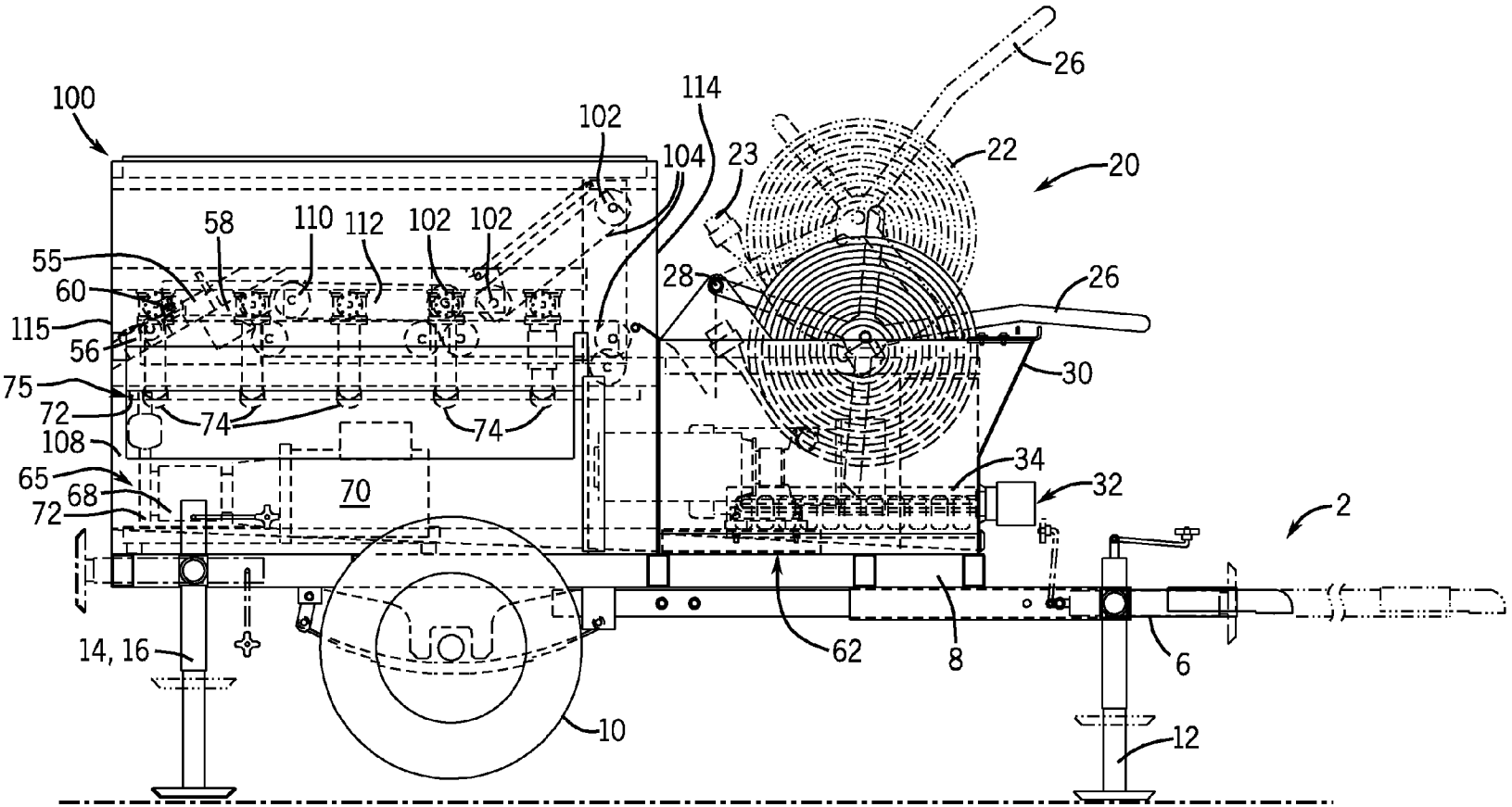
FIG. 1 is a section side view of the multi-function hose maintenance and testing system of the present application.

The multi-function hose maintenance and testing system of the present application generally comprises three components: a submersion unit 20, a hose wash unit 100, and a hose test unit 75. The hose wash unit 100 and hose test unit 75 are driven by a pump unit 65. The air knives 106 are driven by an air compressor unit 62. The control unit 45 operates in conjunction with a control panel 55 to control operation of the multi-function unit.

Figure 2:
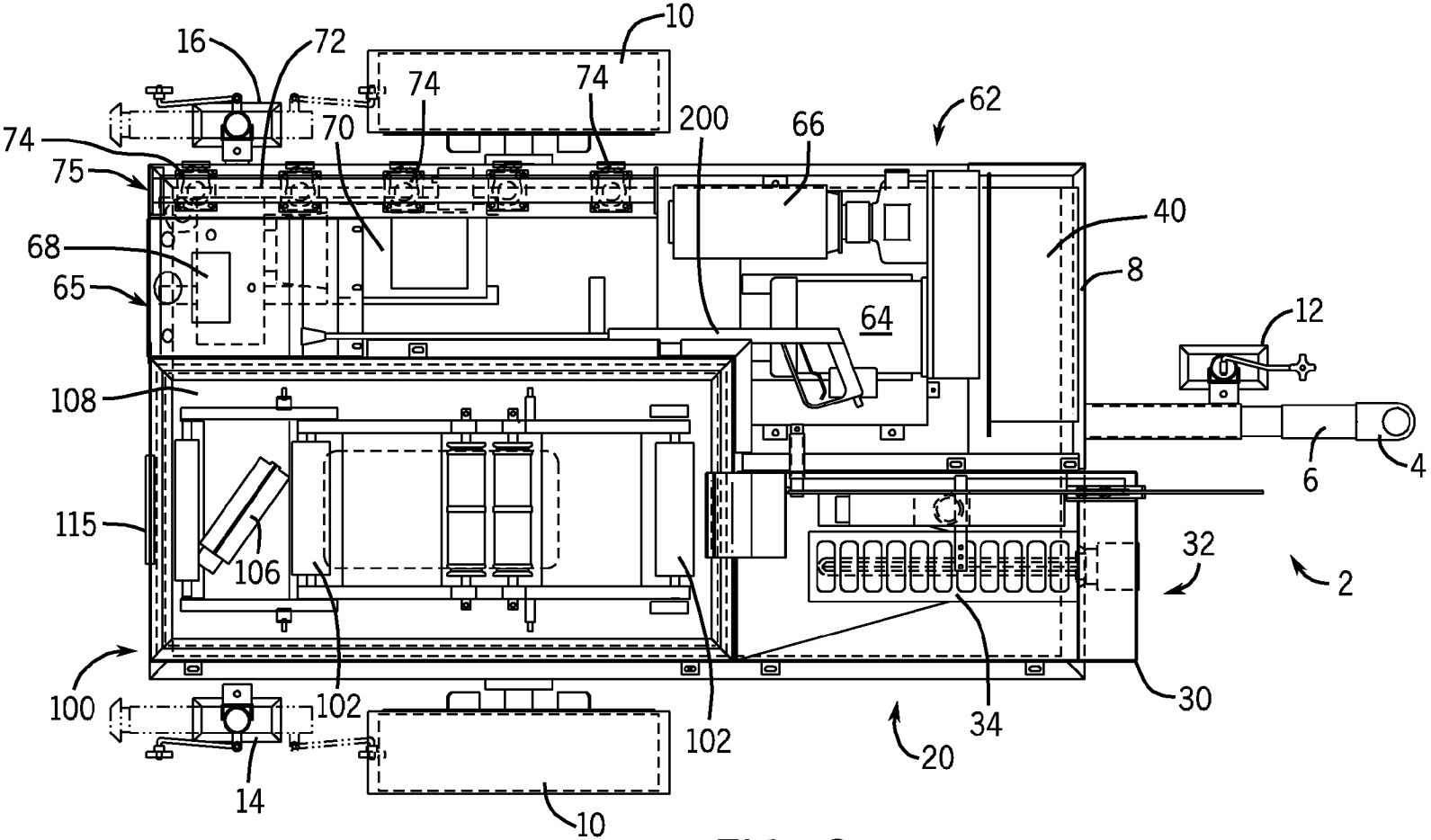
FIG. 2 is a section top view of the multi-function hose maintenance and testing system of the present application.

Referring first to FIGS. 1 and 2, the submersion unit 20 of the multi-function hose maintenance and testing system includes a submersion soak tank 30. The submersion soak tank may be filled with water or a cleaning solution and is used for the initial cleaning and decontamination of a hose 22. The hose 22 may include a hose nozzle 23, and is mounted on a hose spool 24 for entry into the submersion soak tank 30. The hose spool 24 provides a convenient means for winding a hose 22 onto a spool and compacting the hose 22 in a manner such that it may be easily placed into the submersion soak tank 30. This submersion is facilitated by a hose spool arm 26 and a hose spool pivot 28. When an operator exerts a downwardly force on the hose flow arm 26, the hose 22 is lowered into the submersion soak tank 30. Conversely, when an operator places an upwardly force on the hose arm 26, the hose 22 may be raised from the submersion soak tank 30. As the hose 22 is submersed in the soak tank 30, the hose spool 24 may be turned by the operator such that the entire hose 22 may be covered with water or solution contained within the submersion soak tank 30. The solution present in the submersion soak tank may include any of the several Dyna Edge solutions available from Cleaning Systems, Inc. of De Pere, Wis. However, any solution that provides the desired cleaning and decontamination of a hose may be used. It is envisioned that environmentally friendly or biodegradable solutions will be used in most embodiments. However, this application is in no way limited by the type of solution used in the submersion soak tank 30.

The submersion soak tank 30 further comprises a heating unit 32 for heating the water solution contained therein. The heating unit 32 includes a heating element 34 located within the submersion soak tank 30 for heating the water solution at a preferred temperature. In one embodiment, the temperature ranges from 33-250°, in another embodiment, the temperature ranges from 90-190°, and in yet another embodiment, the temperatures ranges from 120-160°.

Once the hose 22 is treated in the submersion soak tank 30, the hose 22 may be fed from the hose spool 24 into the hose wash unit 100. The hose wash unit comprises a plurality of adjustable roller units 102 supporting a flexible track 104. At least one of the plurality of adjustable roller units 102 comprises a power roller 110 for imparting a driving force on the track 104. Acceptable power rollers are available from Itoh Denki USA of Hanover Township, Pennsylvania. The flexible track 104 is designed to grip the hose 22 and lead the hose through the wash unit 100. The plurality of adjustable roller units 102 include roller spacers 112 for adjusting the tension of the flexible track 104.

Within the hose wash unit 100 are at least one wash nozzle (not shown) for applying pressure as water or solution to the hose as it travels through the wash unit 100. The presence of wash nozzles are well known in the art and may be arranged in any manner along the track to supply pressurized water or solution to the hose 22 as it travels through the wash unit 100. In one embodiment, the wash nozzles are located at a central location along the track 104, but may be placed at any location as desired by the manufacturer. The hose wash unit 100 includes at least one air knife 106 for drying the hose 22 as it exits the wash unit 100. In one embodiment, an air knife 106 is located both above and below the hose as it exits the wash unit such that both sides of the hose may be dried. The drying of the hose 22 after washing is advantageous because it prevents the build-up of mildew or other contaminants on the hose. Utilization of at least one air knife 106 decreases drying time of a washed hose by 60-70%. Moreover, when the submersion unit 20 and the wash unit 100 are used together, the wash and decontamination system is significantly more efficient, since in the system of the present application, the hose 22 need only run through the submersion unit 20 and the hose wash unit 100 once, wherein in the prior art it is necessary to run the hose through the wash unit multiple times to achieve sufficient cleaning.

The hose wash unit 100 also includes a reservoir tank 108 for collecting waste water or solution used during the washing of a hose 22. The reservoir tank 108 may include a drain (not shown) that can be selectively opened or closed by the operator. The presence of a drain that may be selectively opened or closed is particularly advantageous in embodiments where the multi-function system is mounted on a trailer platform 8 for easy movement from location to location. Particularly, the reservoir tank 108 may be filled during the washing process in one location and may subsequently be moved to a second location where the reservoir tank 108 may be drained in a manner that provides safe and efficient disposal of the waste water or solution.

The wash unit 100 defines a hose path from hose entry 114 to hose exit 115. A portion of the flexible track 104 is located above the hose path and a portion of the flexible track 104 is located below the hose path such that the hose is fed from the hose spool 24 into the hose entry 114 along track 104 to the hose exit 115. The wash nozzles wash the hose 22 as it travels through the hose path and the air knives 106 dry the hose as it exits the hose path. The plurality of adjustable roller units 102 operates such that when a bulky member such as a hose nozzle 23 enters the hose path, the adjustable rollers adjust to accommodate the nozzle 23 and then re-adjust to grip the hose 22 as the hose 22 travels along the hose path. This operation provides a highly efficient manner of washing and decontaminating the hose.

The wash nozzles of the wash unit 100 supply pressurized water solution with the aid of pump unit 65. As shown in FIG. 2, the air compressor unit 62 includes a motor 64 and air filter 66. As shown in FIG. 1, the pump unit 65 includes pump 68 and pump motor 70. In one embodiment, the pump unit 65 may include a water heater 69 as shown in FIG. 2. The pump unit 65 provides pressurized water or solution to the wash nozzles of the hose unit 100 and also to a hose test unit 75 as will be described herein. Optionally, the pump unit 65 may also supply water to a pressure wash gun 200 that an operator may use for pressure washing an object. As mentioned, the air compressor unit 62 operates to supply air to the at least one air knife 106 of the hose wash unit 100. In one embodiment, a series of conduits (e.g., conduit 72) and flexible hoses are used to supply pressurized water from the pump unit 65 to the hose wash unit 100 and a hose test unit 75.

Figure 3:
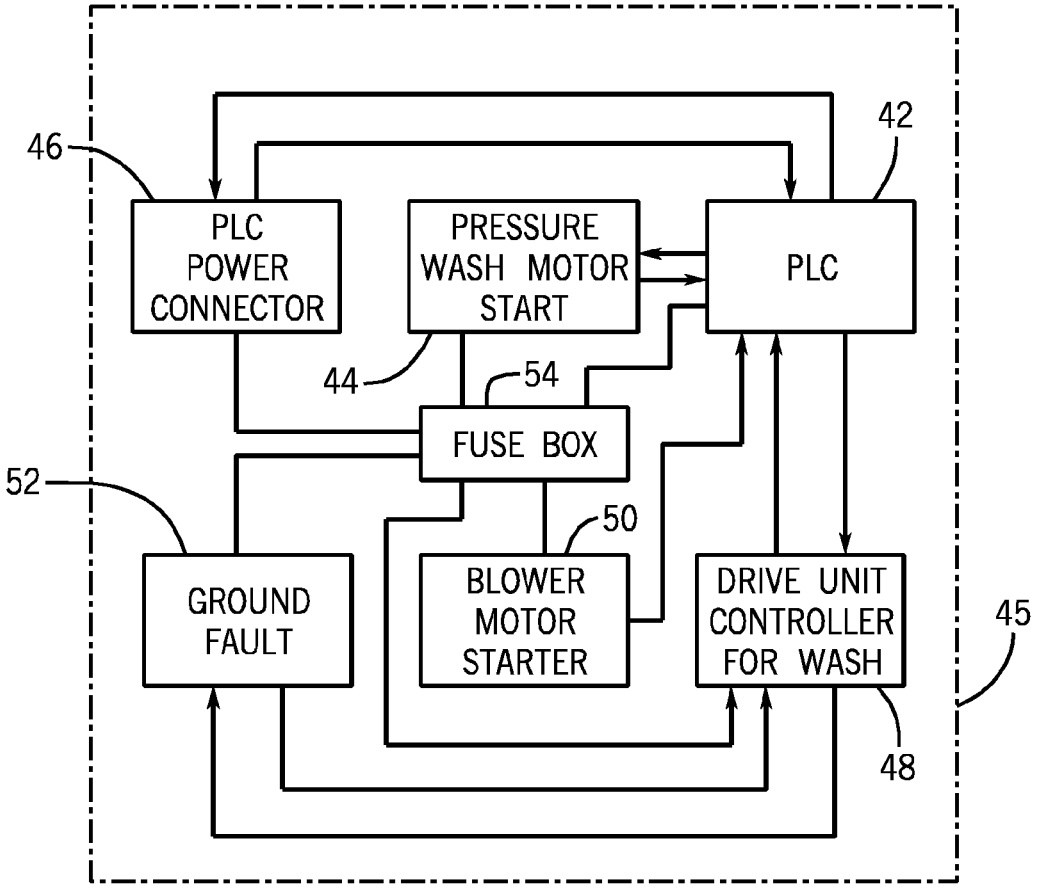
FIG. 3 is a schematic view of the electrical box components of the multi-function hose maintenance and testing system of the present application.

As shown in FIG. 1, the multi-function hose maintenance and testing system of the present application includes a control panel 55 for controlling the operation of the system. The control panel 55 includes a master on/off switch 56, a PLC control panel 58 and a pump control 60. The components of the control panel 55 are operatively connected to the electrical box 40 shown in FIG. 2. The electrical box 40 houses the control unit 45 of FIG. 3. As shown in FIG. 3, control unit 45 comprises a programmable logic controller (PLC) 42. An acceptable PLC is available from Siemens Energy and Automation, Inc. of Alpharetta, Ga. The control unit 45 may also include, in one embodiment, a pump motor starter 44 and an air compressor motor starter 50. In an alternative embodiment, a common starter could be used to start both the pump motor 70 and the air compressor motor 64. The control unit 45 may also include, in one embodiment, a ground fault 52 and a drive unit controller 48 for controlling hose wash unit 100. The control unit 45 may also include a fuse box 54. In one embodiment, the control unit 45 includes a PLC power converter 46 for converting single phase power into three phase power for operation of the various components of the multi-function hose maintenance and testing system of the present application. The power converter 46 allows for the multi-function hose maintenance and testing system of the present application to be used in virtually any environment that has a traditional power supply.

As shown in FIG. 1, the multi-function hose maintenance and testing system of the present application may include a conventional hose test unit 75. Hose test unit 75 comprises a manifold 72 and a plurality of hose fittings 74. Pressurized water is supplied to the manifold from pump unit 65 and additional pressure may be supplied from air compressor unit 62.

In one embodiment, the multi-function hose maintenance and testing system is a portable multi-function washing and decontamination system for hoses. To achieve portability, the wash unit 100, the submersion unit 20, the hose test unit 75, blower unit 62 and pump unit 65 are mounted on a trailer 2. The trailer 2 comprises a trailer platform 8 for supporting the hose wash unit 100, the submersion unit 20, the blower unit 62, the hose test unit 75 and the pump unit 65. The trailer 2 further includes a trailer arm 6 having a trailer coupler 4 for attaching the trailer 2 to a vehicle. The trailer includes at least one wheel 10 for providing portability. The trailer 2 also includes at least one trailer jack for supporting the portable, multi-function system when stationary. In one embodiment, the trailer 2 includes a front trailer jack 12, and a pair of rear trailer jacks 14 and 16. When the multi-function system of the present application is mounted on a trailer 2, the multi-function system may be easily transported from one location to another, yet the system may also be safely positioned at any desired location.

It should be further apparent to those skilled in the art that the present invention, as described herein, contains several features and that variations to the best mode disclosed herein may be made which embody only some of the features disclosed herein. Various other combinations and modifications or alternatives may also be apparent to those skilled in the art. Such variations and alternatives and other embodiments are contemplated as being within the scope of the following claims which distinctly claim and particularly point out the present invention.

What is claimed is:

1. A multi-function system for maintenance of a hose, the system comprising: a submersion unit and a wash unit, the wash unit driven by a motorized pump; wherein the submersion unit comprises a hose spool for supporting a hose, and a submersion soak tank for receiving the hose on the spool; wherein the hose spool comprises an arm for lowering the spool into the submersion tank by an operator and a pivot for lowering the spool into the submersion tank by the operator, the arm and pivot extending radially outwardly from the hose spool in substantially opposite and substantially fixed radial directions; and wherein the wash unit comprises a plurality of adjustable roller units supporting a flexible track, at least one wash nozzle, and at least one air knife, such that the plurality of roller units and flexible track are arranged to define a hose path along the hose to be fed from the submersion unit hose spool, along the flexible track and past the wash nozzles and air knives to wash and dry the hose.

2. A multi-function system for maintenance of a hose as described in claim 1, wherein the system further comprises a control unit, the control unit comprising: an electrical box having a PLC; at least one motor starter; and a control panel having an on/off switch and a PLC control interface operatively connected to the components of the electrical box.

3. A multi-function system for maintenance of a hose according to claim 1, wherein the multi-function system is mounted on a trailer.

4. The multi-function system for maintenance of a hose according, to claim 3, wherein the trailer comprises: a support platform for supporting the multi-function system; at least one wheel; a trailer coupler means; and at least one jack for supporting the trailer when stationary.

5. A multi-function system for maintenance of a hose according to claim 1, wherein the wash unit further comprises a reservoir tank for receiving waste water or waster solution used in washing a hose.

6. A multi-function system for maintenance of a hose according to claim 5, wherein the reservoir tank includes a drain that may be opened or closed by an operator.

7. A multi-function system for maintenance of a hose according to claim 1, wherein the system further comprises a hand held pressure wash gun attached to the motorized pump.

8. A multi-function system for maintenance of a hose according to claim 1, wherein the system further comprises a motorized air compressor unit for supplying pressurized air to the at least one air knife of the wash unit.

9. A multi-function system for maintenance of a hose according to claim 8, wherein the system further comprises a hose test unit, the hose test unit comprising a manifold with a plurality of hose fittings, the manifold operatively connected to the motorized pump and motorized air compressor unit, such that pressurized water may be supplied to the hose fittings for testing a hose.

10. A multi-function system for maintenance of a hose according to claim 1, wherein the hose spool comprises an arm extending radially outwardly from the spool and a pivot member also extending radially outwardly from the spool on one end, and attached to the submersion tank on a second end, the arm and pivot member operable for lowering the spool into the submersion tank, such that when an operator provides a downwardly force on the arm, the spool is lowered into the tank.

11. A multi-function system for maintenance of a hose according to claim 1, wherein the plurality of adjustable roller units adjust to accommodate a nozzle of a hose as the hose nozzle passes along the hose path while maintaining frictional contact with the hose, and wherein the plurality of adjustable roller units comprises at least one power roller for driving the flexible track.

12. A multi-function system for maintenance of a hose according to claim 1, wherein the hose path comprises a portion of a flexible track being located above the hose path, and a portion of the flexible track being located below the hose path and wherein the at least one air knife is located at a terminal end of the hose path.

13. A multi-function system for maintenance of a hose according to claim 2, wherein the control unit comprises a power converter for converting single phase power to three stage power such that the control unit may proportionally drive a power roller unit.

14. A multi-function system for maintenance of a hose according to claim 1, wherein a solution is provided in the submersion soak tank and through the wash nozzles for cleaning a hose, and wherein the submersion soak tank further comprises a heating unit for heating the solution.

15. A multi-function system for maintenance of a hose according to claim 14, wherein the solution is biodegradable.

16. A portable, multi-function system for maintenance and testing of a hose, the system comprising: a submersion unit; a wash unit; a control unit; a hose test unit; a pump unit; and an air compressor unit; wherein the multi-function system is positioned on a trailer having at least one wheel and a coupler for coupling the trailer to a vehicle; and wherein the submersion unit comprises a submersion tank and a hose spool for supporting a hose, the hose spool having an arm and a pivot for lowering the spool into the submersion tank by an operator, the arm and pivot extending radially outwardly from the hose spool in substantially opposite and substantially fixed radial directions.

17. A portable, multi-function system for maintenance and testing of a hose according to claim 16, wherein the trailer further comprises a trailer arm for supporting the coupler for coupling the trailer to a vehicle; a platform for supporting the multi-function system; and at least one jack for supporting the trailer in a stationary position.

18. A portable, multi-function system for maintenance and testing of a hose according to claim 16, wherein the submersion unit further comprises: a heating unit having a heating element for heating water or solution contained in the submersion soak tank.

19. A portable, multi-function system for maintenance and testing of a hose according to claim 16, wherein the wash unit receives a hose from the submersion unit, and wherein the wash unit comprises: a plurality of adjustable roller units supporting a flexible track, at least one of the roller units being a power roller unit for generating a force for moving the flexible track; a plurality of roller spacers for tensioning the flexible track; a plurality of nozzles for supplying pressurized water or solution; at least one air knife; and a reservoir tank for collecting waste water or waste solution; wherein the wash unit defines a hose path having a portion of flexible track above the hose path and a portion of flexible track below the hose path such that a hose is fed from the submersion unit through the hose path, wherein the nozzles wash the hose as it travels through the hose path and the at least one air knife dries the hose as it exits the hose path.

20. A portable, multi-function system for maintenance and testing of a hose as described in claim 16, wherein the hose test unit comprises a manifold and a plurality of hose fittings; and wherein the manifold is operatively connected to the pump unit such that pressurized water may be supplied to the hose fittings through a hose to be tested.

21. A portable, multi-function system for maintenance and testing of a hose according to claim 16, wherein the control unit comprises: an electrical box having a PLC, a wash unit controller, at least one motor starter, a fuse box, and a ground fault; a control panel having a master on/off switch and a PLC interface; and a PLC power converter for converting single phase power to three phase power.

22. A portable, multi-function system for maintenance and testing of a hose according to claim 16, wherein the air compressor unit comprises a motor, an air intake, an air filter, and an outlet.

23. A portable, multi-function system for maintenance and testing of a hose according to claim 21, wherein the pump unit comprises a motor and a pump, and the motor starter starts the motor of the pump.

24. A portable, multi-function system for maintenance and testing of a hose according to claim 19, wherein the reservoir tank includes a drain that may be opened or closed by an operator.

25. A portable, multi-function system for maintenance and testing of a hose according to claim 16, wherein the system further comprises a hand held pressure wash gun operatively attached to the pump unit.

26. A portable, multi-function system for maintenance and testing of a hose according to claim 19, wherein the plurality of adjustable roller units adjust to accommodate a nozzle of a hose as the hose nozzle passes along the hose path while maintaining frictional contact with the hose.

27. A portable, multi-function system for maintenance and testing of a hose according to claim 16, wherein a solution is provided in the submersion unit and wash unit for cleaning a hose.

28. A portable, multi-function system for maintenance and testing of a hose according to claim 27, wherein the solution is biodegradable.

* * * * *